US012588729B2

(12) United States Patent
Fumey

(10) Patent No.: US 12,588,729 B2
(45) Date of Patent: Mar. 31, 2026

(54) CAP SECURING DEVICE

(71) Applicant: William Lloyd Fumey, Clarksville, MD (US)

(72) Inventor: William Lloyd Fumey, Clarksville, MD (US)

( * ) Notice: Subject to any disclaimer, the term of this patent is extended or adjusted under 35 U.S.C. 154(b) by 0 days.

(21) Appl. No.: 19/220,437

(22) Filed: May 28, 2025

(65) Prior Publication Data

US 2025/0288046 A1 Sep. 18, 2025

Related U.S. Application Data

(63) Continuation-in-part of application No. 18/914,707, filed on Oct. 14, 2024, which is a continuation-in-part of application No. 18/536,575, filed on Dec. 12, 2023, now Pat. No. 12,342,892.

(60) Provisional application No. 63/539,001, filed on Sep. 18, 2023.

(51) Int. Cl.
*A42B 7/00* (2006.01)
*A42B 1/002* (2021.01)

(52) U.S. Cl.
CPC ..... *A42B 7/00* (2013.01); *A42B 1/002* (2013.01)

(58) Field of Classification Search
CPC .. A42B 1/002; A42B 1/02; A42B 1/04; A42B 1/22; A42B 1/24; A42B 1/242; A42B 1/205; A42B 7/00; A44B 11/02; A44B 11/06; A41G 5/0093; A47B 2097/003; A45D 8/36; A45D 8/004; A45D 8/006
See application file for complete search history.

(56) References Cited

U.S. PATENT DOCUMENTS 58,329 A * 9/1866 White ..... A42B 1/002 2/175.4
163,913 A * 6/1875 Blackwood ..... A42B 7/00 132/59
215,998 A * 5/1879 Waddell et al. ..... A42B 1/22 2/181.2
248,542 A * 10/1881 Wilson ..... A45D 8/12 132/275

(Continued)

FOREIGN PATENT DOCUMENTS

KR 20240039081 A * 3/2024 ..... A42B 1/206
WO WO-2018199411 A1 * 11/2018 ..... A44B 17/00

*Primary Examiner* — Heather Mangine
*Assistant Examiner* — Raquel M. Weis
(74) *Attorney, Agent, or Firm* — Dunlap Bennett & Ludwig PLLC; Anna L. Kinney

(57) ABSTRACT

A cap securing assembly for graduation caps addresses the challenge of maintaining cap stability on wearers' heads, particularly for individuals with curly or voluminous hairstyles. A headband is secured to an interior surface of the graduation cap, e.g., with adhesive tape, ensuring a firm yet comfortable fit. The device can include a shaper bowl with an inner surface, an outer surface, and double-sided self-adhesive material to retain the cap's shape and secure excess fabric. The headband can be fastened to the shaper bowl interior, e.g., by clips or adhesive tape. The headband can include a securing assembly having a base with adhesive material and a spring clip for removable attachment to the headband. This configuration allows for easy detachment during ceremonial use, such as cap tossing, while preserving the cap's integrity. The device is adaptable for other headwear types, offering a versatile, cost-effective solution to cap stability and aesthetic challenges.

9 Claims, 12 Drawing Sheets

(56) References Cited

U.S. PATENT DOCUMENTS 275,670 A * 4/1883 Kendall ..... A42B 7/00 2/181.6
290,365 A * 12/1883 Smith ..... A42B 7/00 132/60
328,729 A * 10/1885 Smith ..... A42B 7/00 132/141
422,137 A * 2/1890 Massey ..... A42B 7/00 2/175.7
555,100 A * 2/1896 Jones ..... A42B 7/00 24/362
600,543 A * 3/1898 Martyn ..... A42B 7/00 132/63.1
612,796 A * 10/1898 Bliss ..... A42B 1/004 2/209.3
671,887 A * 4/1901 Huppertz ..... A42B 7/00 132/59
678,725 A * 7/1901 Gauen ..... A42B 7/00 132/59
753,314 A * 3/1904 Rickard ..... A42B 7/00 132/57.1
761,601 A * 5/1904 Oliver ..... A42B 1/002 2/175.4
836,899 A * 11/1906 Smith ..... A42B 1/02 2/171.01
1,283,686 A * 11/1918 Dahl ..... A42B 7/00 132/59
1,324,412 A * 12/1919 Rust ..... A42B 1/002 2/175.4
1,391,123 A * 9/1921 Koyomjian ..... A42B 1/002 2/181.2
1,447,602 A * 3/1923 Pierce ..... A42B 1/002 2/175.4
1,692,719 A * 11/1928 Busey ..... A42B 7/00 132/273
1,715,331 A * 5/1929 Richter ..... A45D 8/36 132/275
1,745,184 A * 1/1930 Myers ..... A42B 1/02 2/171.01
1,899,636 A * 2/1933 Raulerson ..... A42B 1/002 2/175.4
1,934,114 A * 11/1933 Brander ..... A42B 1/02 2/171.01
2,153,146 A * 4/1939 Holmes ..... A42B 1/02 2/171.01
2,248,497 A * 7/1941 Gelvin ..... A42B 1/02 2/200.3
2,289,370 A * 7/1942 Krag ..... A42B 1/02 2/171.01
2,490,508 A * 12/1949 Delgatto ..... A42B 1/002 223/84
2,629,874 A * 2/1953 La Maida ..... A42B 1/02 2/209.3
2,849,007 A * 8/1958 Behr ..... A45D 8/36 132/148
3,134,107 A * 5/1964 Thomas ..... A42B 1/02 2/200.3
3,211,160 A * 10/1965 Miller ..... A45D 8/36 132/275
4,491,256 A * 1/1985 Payne ..... D06F 59/02 223/24
4,936,699 A * 6/1990 Yoshida ..... A63H 33/00 63/11
5,027,992 A * 7/1991 Murray, III ..... G09F 21/02 D2/869
5,427,123 A * 6/1995 Odenthal ..... A45D 8/36 132/275
5,829,457 A * 11/1998 Huang ..... A45C 13/08 63/3
5,857,469 A * 1/1999 Sowell ..... A45D 8/24 132/278
5,901,381 A * 5/1999 Nelson ..... A41D 20/00 2/244
5,913,316 A * 6/1999 Chou ..... A45D 8/36 132/273
5,926,848 A * 7/1999 Bartholomae ..... A45D 8/36 132/273
5,934,294 A * 8/1999 Chiang ..... A45D 8/006 63/15
5,975,092 A * 11/1999 Tsai ..... A45D 8/20 132/273
6,024,102 A * 2/2000 Huang ..... A45D 8/36 132/273
6,049,912 A * 4/2000 Linehan ..... G09F 21/02 2/244
6,237,611 B1 * 5/2001 LeCrone ..... A42B 1/24 132/275
6,357,052 B1 * 3/2002 Fleming ..... A42B 1/004 2/244
6,513,167 B1 * 2/2003 Cheng ..... A45D 8/36 2/209.13
6,688,316 B1 * 2/2004 Klug ..... A45D 8/002 211/13.1
9,089,178 B1 * 7/2015 Clarke ..... A41G 3/0058
9,241,526 B2 * 1/2016 Goldberg ..... A42B 1/248
9,936,753 B2 * 4/2018 Yeh ..... A41G 7/00
D820,519 S * 6/2018 Templer ..... D2/866
D852,464 S * 7/2019 Kirschner ..... D2/882
D855,292 S * 8/2019 Robinson ..... D2/866
10,945,474 B2 * 3/2021 Atkinson-Skinner .... A45D 8/36
11,317,669 B1 * 5/2022 Curry ..... A42B 1/002
2003/0121127 A1 * 7/2003 Walker ..... A41D 20/00 24/306
2003/0200981 A1 * 10/2003 Silva ..... A45D 8/36 132/273
2003/0221242 A1 * 12/2003 Yeh ..... A42B 7/00 132/273
2004/0231031 A1 * 11/2004 Cho ..... A42B 1/0181 2/175.4
2005/0056298 A1 * 3/2005 McRoberts ..... A45D 8/34 132/276
2006/0054176 A1 * 3/2006 Buchman-Ziv ..... A45D 8/36 132/60
2008/0202548 A1 * 8/2008 Fala ..... A45D 8/36 132/273
2009/0032044 A1 * 2/2009 Grimm ..... A45D 8/12 132/273
2009/0235945 A1 * 9/2009 Eaton ..... A41G 5/0026 132/275
2010/0277944 A1 * 11/2010 Hurwitz ..... A45D 8/36 2/244
2011/0146701 A1 * 6/2011 Chou ..... A45D 8/36 132/275
2012/0118317 A1 * 5/2012 Payne ..... A45D 8/006 132/275
2012/0246800 A1 * 10/2012 Liu ..... A45D 8/36 2/209.13
2012/0247495 A1 * 10/2012 Montgomery ..... A41G 5/0093 132/54
2014/0083444 A1 * 3/2014 Grimm ..... A45D 8/12 132/148
2014/0130819 A1 * 5/2014 Karam ..... A41G 5/0093 132/54
2016/0073757 A1 * 3/2016 Beckerman ..... A45D 8/36 132/200
2016/0249701 A1 * 9/2016 Xiong ..... A42B 3/085 2/421
2017/0049174 A1 * 2/2017 Holcomb ..... A42B 1/004
2017/0099928 A1 * 4/2017 Krebsbach ..... A43B 23/24
2018/0020798 A1 * 1/2018 Gjertsen ..... A45D 8/34 132/275
2022/0295936 A1 * 9/2022 Wright ..... A42B 7/00
2023/0309639 A1 * 10/2023 Twining ..... A42B 1/002 2/175.4
2025/0089833 A1 * 3/2025 Fumey ..... A42B 1/22
2025/0089839 A1 * 3/2025 Fumey ..... A42B 1/02
2025/0288046 A1 * 9/2025 Fumey ..... A42B 7/00

* cited by examiner

CAP SECURING DEVICE

CROSS-REFERENCE TO RELATED APPLICATION

This application is a continuation in part of U.S. nonprovisional application Ser. No. 18/914,707, filed Oct. 14, 2024. U.S. nonprovisional application Ser. No. 18/914,707 is a continuation in part of U.S. nonprovisional application Ser. No. 18/536,575, filed Dec. 12, 2023. Application Ser. No. 18/536,575 claims the benefit of priority of U.S. provisional application No. 63/539,001, filed Sep. 18, 2023. The contents of application Ser. Nos. 18/914,707, 18/536,575, and 63/539,001 are herein incorporated by reference in their entireties.

BACKGROUND OF THE INVENTION

The present invention relates to graduation caps, and more particularly to a cap shaping and securing device for attaching a graduation cap to a user's head.

While graduation ceremonies from, e.g., high schools, colleges, and universities are typically celebrations of joy, pomp, and achievement, keeping a graduation cap firmly on one's head, for certain individuals, can be problematic.

Graduation caps, commonly known as mortar boards, have remained largely unchanged for generations and are typically available in limited sizes. Graduation caps, or academic caps, typically consist of a skull cap with a square board fixed on top, which may be rigid or flexible, to which is fixed a crown, and across a predetermined side of which a tassel may lay. The crown is used to firmly secure a mortar board atop a graduate's head. The topside and crown each consist of inner layers of rather stiff material enclosed by high quality cloth material. This lack of customization, combined with minimal structural support, makes it challenging for wearers to keep the cap securely in place. These caps often interfere with hairstyles, especially those with kinky, curly, or voluminous hairstyles, and are even more difficult to secure firmly on the wearer's head with a curly or voluminous hairstyle. Traditional securing methods, such as using pins, can damage the cap, which is undesirable for rented caps. Modifications to caps often require expert handling, making them impractical and costly.

Existing devices for retaining the shape of graduation caps and attaching them to headbands are either complex to assemble, expensive to produce, or fail to secure the cap effectively. Loose fabric around the cap shaper can result in an untidy appearance, and detaching such devices for ceremonial purposes can be time-consuming.

As can be seen, there is a need for a device that secures a graduation cap firmly on the wearer's head without damaging the cap or interfering with hairstyles, and retains the shape of the cap, ensuring excess fabric is neatly secured.

SUMMARY OF THE INVENTION

In one aspect, the disclosure includes a cap securing system comprising a headband configured to be positioned about a wearer's head and an attachment means operatively interconnecting the headband and a cap for releasably engaging the cap, such that the headband and the attachment means cooperate to secure the cap to the wearer's head. In some implementations, the system further comprises a shaper bowl having an inner surface and an outer surface configured to retain the shape of the cap, wherein the attachment means interconnects the headband to the cap by fastening the headband to the inner surface and mounting the cap to the outer surface. In additional embodiments, the shaper bowl includes double-sided adhesive material affixed to at least one of the surfaces of the shaper bowl to detachably engage a portion of the cap and secure excess fabric, while in other cases the headband is coupled to the shaper bowl without the use of an adhesive. Further, the attachment means may comprise a platform formed on the headband with adhesive material secured to the upper surface of the platform or a base with a lateral projection forming a spring clip configured to removably secure the headband to the base, and the system may also include a plurality of protrusions on a concave surface of the headband configured to engage the wearer's hair. The attachment means may be selected from a clip, a hook and loop fastener, self-adhesive tape, holes for accommodating the headband, a snap-fit fastener, or any combination thereof.

In another aspect, the disclosure includes a method of securing a cap to a wearer's head comprising providing the cap securing system, attaching the attachment means to the cap, and positioning the headband, with the cap attached, onto the wearer's head so that the headband engages the wearer's hair. In some implementations, the method further comprises employing a shaper bowl having an inner surface and an outer surface for retaining the shape of the cap, wherein the shaper bowl includes a re-adherable adhesive material affixed to at least one of the concave inner surface or convex outer surface of the shaper bowl to detachably engage a portion of the cap. In certain embodiments, the re-adherable adhesive material is selected from the group consisting of double-sided adhesive tape, carbon nanotube tape, poster tape, hook and loop closures, poster putty, or any combination thereof.

These and other features, aspects and advantages of the present invention will become better understood with reference to the following drawings, description, and claims.

Figure 1:
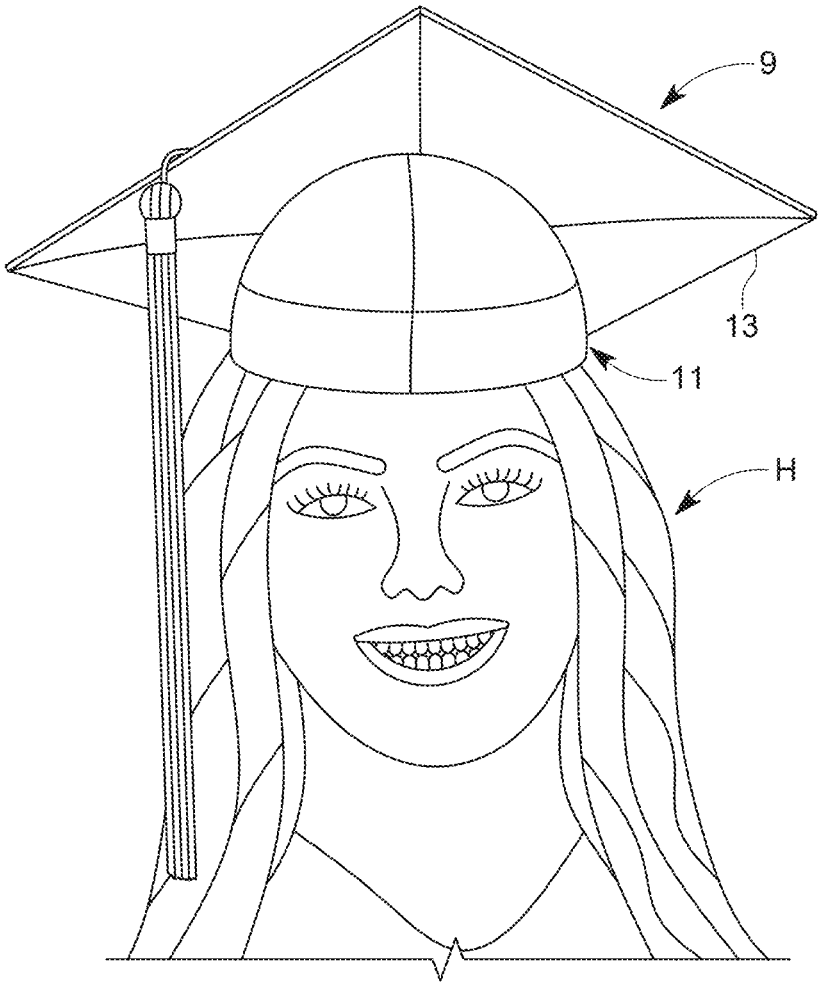
FIG. 1 is a front elevation view of a graduation cap worn on a head, showing the crown and square flat top, illustrating an embodiment of the present invention shown in use.

Throughout the drawing figures and the detailed description, similar alphanumeric references shall be used to refer to features of the present subject matter that are similar.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention provides a cap securing device for graduation caps, particularly for wearers with curly or voluminous hair. The device is simple to use, cost-effective, and versatile, as it can be used with other types of hats, such as military or decorative hats.

A headband component of the device allows the wearer to secure the cap to the wearer's head. In some embodiments, the headband may have regularly spaced protrusions or teeth on a concave surface of the headband. In some cases, the protrusions, may, for example, extend normal to the headband surface and form a 90° bend, enhancing the headband's grasp on the user's hair. In embodiments, the protrusions or teeth may extend beyond the lateral edge of the headband.

The headband may be a securing headband or a component of an attachment system comprising a headband and a securing device assembly. The securing device features a base with upper and lower surfaces, a lateral side surface with an integral projection, a spring clip, and adhesive material. The spring clip, unitary with the projection, removably secures the base to the headband, while the adhesive material attaches the base to the inner upper surface of the cap. The adhesive material may include materials such as hook and loop closures, wood glue, elastomers, silicone sealants, or pressure-sensitive adhesives. In embodiments, the securing headband may comprise a mounting platform integrally formed with an arcuate band, said mounting platform comprising a substantially rectangular prismatic structure positioned at the apex of a convex surface of the arcuate headband. The mounting platform may include a planar upper surface configured for adhesive attachment to headwear or to a shaping element for headwear. The mounting platform's vertical axis is substantially perpendicular to the tangent plane of the arcuate headband at their point of integration, such that the mounting platform provides a stable coupling interface between the headband and the headwear structure while maintaining the structural integrity of the headband assembly.

In some embodiments, the device includes a shaper bowl with a concave inner surface, a convex outer surface, and a double-sided self-adhesive material that retains the cap's shape and allows for easy detachment and reattachment. The adhesive material secures excess fabric around the shaper bowl, ensuring a neat appearance. The shaper bowl is fastened to a headband using attachment means such as clips, Velcro®, self-adhesive tape, or apertures. The headband secures the cap to the wearer's head without relying on elastic bands, which are often too loose or tight. During use, the shaper bowl is placed inside the cap, and excess fabric is adhered to the adhesive strip. The cap, containing the shaper bowl and headband, is then worn securely on the head. For ceremonial purposes, such as tossing the cap, the shaper bowl can be quickly detached.

In some embodiments, the shaper bowl may have a substantially flat crown portion and a rim having a substantially frustoconical shape. An interior surface of the flat crown portion may have a coupling mated to the mounting platform of the headband. For example, the interior surface of the crown may have slots and the mounting platform may have protrusions that snap into the slots or vice versa.

The shaper bowl retains the shape of the graduation cap in a manner that allows it to sit on the head of the wearer without interfering with the wearer's hairstyle and negates the need of relying on an elastic band common with graduation caps, which is generally too loose or too tight. A re-adherable adhesive surface on the shaper bowl (inside, outside, or both) secures the graduation cap to the shaper bowl and also allows it to be quickly detached. For example, a double-sided self-adhesive material, such as nano tape or carbon nano tube tape, double-sided adhesive tape; poster tape; hook and loop closures; poster putty; and any combination thereof, etc. may be attached to the inside, outside, or both sides of the bowl. The adhesive material secures excess cap fabric around the shaper bowl.

The means of attaching the headband to the shaper bowl or directly to an interior surface of the cap may be selected from the group consisting of: a clip, Velcro® hook and loop fastener, self-adhesive tape, holes through which the headband hooks, and any combination thereof.

The shaper device may be used as follows. The headband is attached to the shaper bowl. The shaper bowl is placed inside the graduation cap. The excess fabric of the graduation cap is placed inside the shaper bowl and adhered to the re-adherable adhesive strip on the shaper bowl. The graduation cap, containing the shaper bowl and headband, is placed on the wearer's head. When it is time to toss the hat, the shaper bowl quickly detaches from the graduation cap.

In embodiments, the present disclosure excludes barrettes featuring an arm that rotates, such as those described in U.S. Pat. No. 5,857,469, which employ a rotating mechanism to secure hair. Unlike elastic bindings described in U.S. Pat. No. 1,934,114, which depend on stretchable materials to hold hair or headwear in place, the present disclosure avoids the use of elastic components that may lose tension over time or fail to provide sufficient stability for graduation caps. Furthermore, the disclosure does not include a top plate with a base and raised platform, as described in U.S. Patent Application Publication No. 2022/0295936A1, which utilizes a rigid structure for mounting headwear. Instead, the present disclosure employs a combination of a headband and attachment means, such as adhesive materials, spring clips, or snap-fit mechanisms, to securely fasten a graduation cap to the wearer's head while preserving the cap's shape and accommodating various hairstyles.

Referring now to FIGS. 1-13, FIG. 1 shows a graduation cap 9 worn on a head H, illustrating the structural components of the cap. The graduation cap 9 comprises a square flat top 13 securely fixed to a crown 11, which is dimensioned and configured to fit neatly upon the head H of the wearer.

Figure 2:
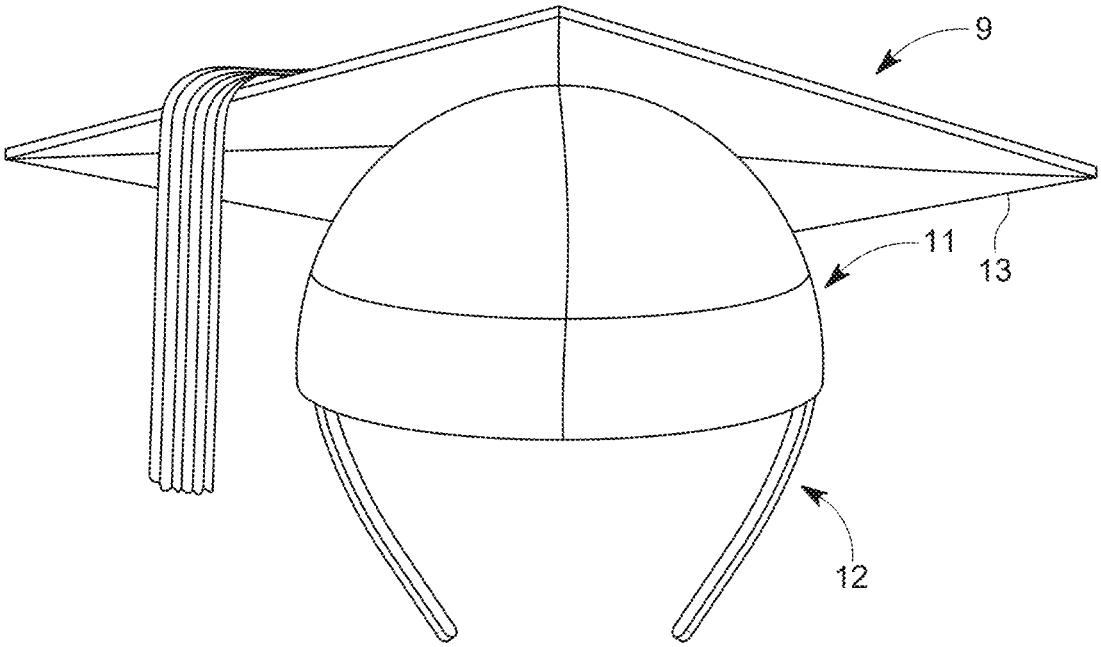
FIG. 2 is a front elevation view illustrating an integrated headband and securing assembly according to an embodiment of the present invention, shown in a use configuration.
Figure 3:
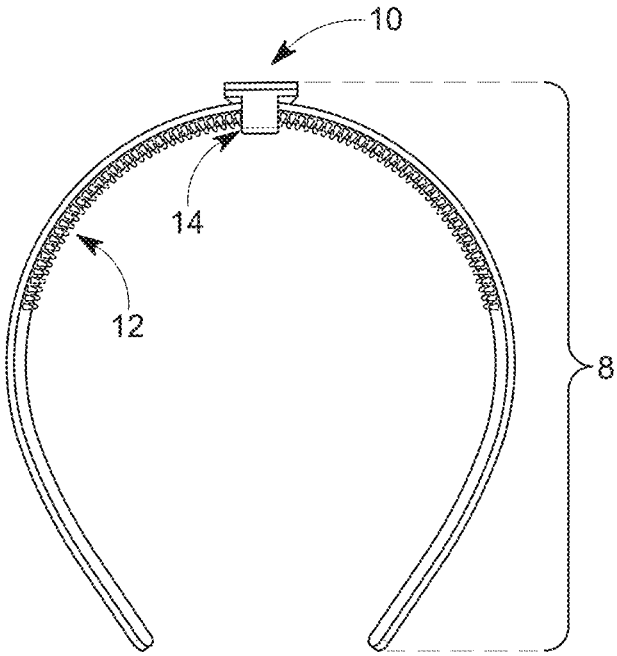
FIG. 3 is another front elevation view if the integrated headband and securing assembly of FIG. 2.

FIGS. 2 and 3 illustrate an attachment system 8 according to an embodiment of the present invention. As shown in FIG. 2, the headband 12 is positioned beneath the crown 11 within the graduation cap 9 and connected to the securing device 10. The attachment system 8 ensures the graduation cap 9 remains firmly in place during use. FIG. 3 provides an unobstructed view of the attachment system 8, which includes the headband 12 and the securing device 10.

Figure 4:
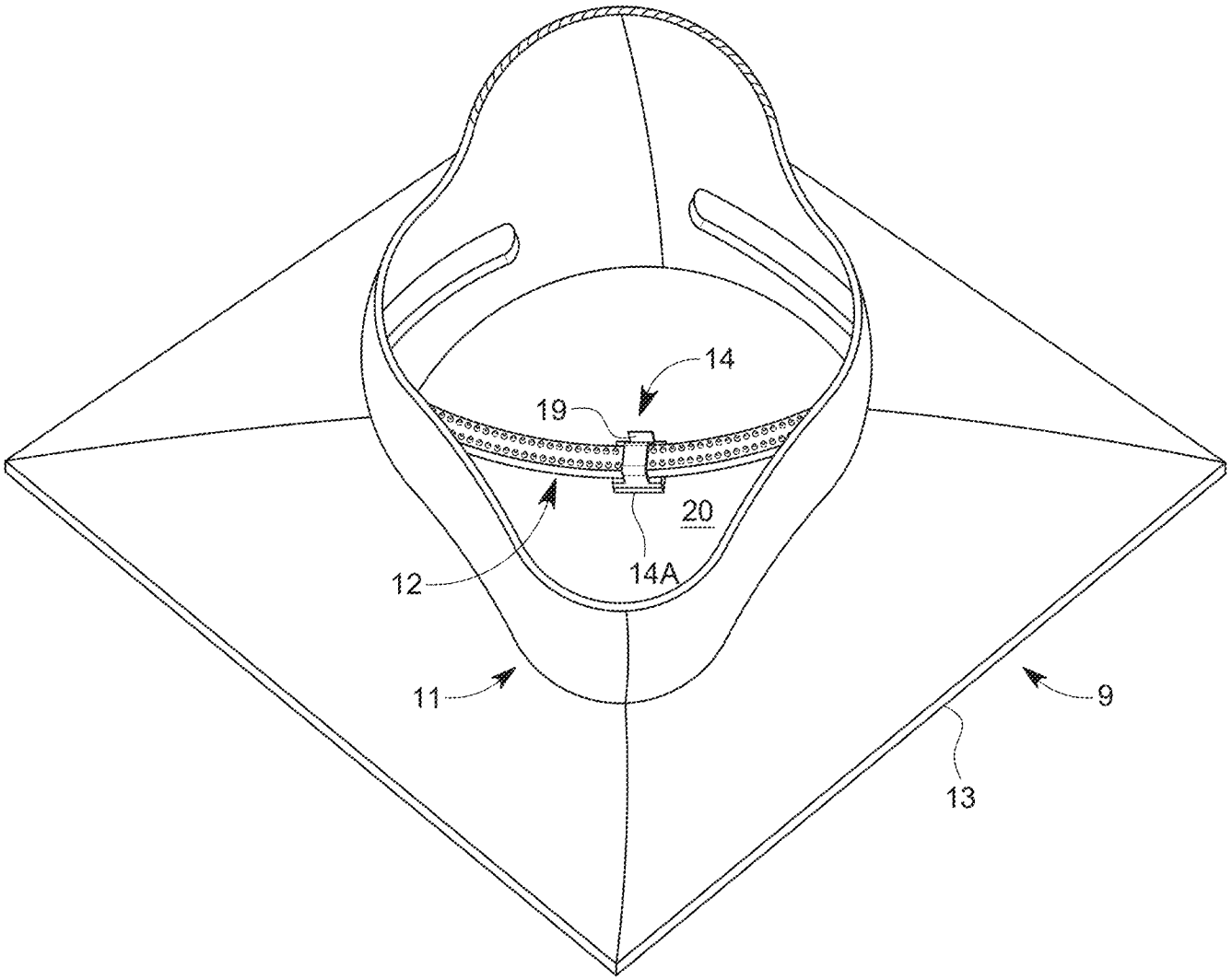
FIG. 4 is a perspective view thereof shown in a use configuration.

FIG. 4 illustrates the attachment system integrated within the graduation cap 9, providing a clear view of its components and their arrangement. The headband 12 is positioned beneath the crown 11 and interacts with the base 14 to secure the cap to the wearer's head.

The tab 19, unitary with the base 14, facilitates the release of the attachment system from the headband 12. This allows the user to easily detach or adjust the graduation cap 9 as needed, ensuring convenience and adaptability during use. The configuration ensures a stable connection between the cap and the attachment system while maintaining ease of detachment for ceremonial purposes.

Figure 5:
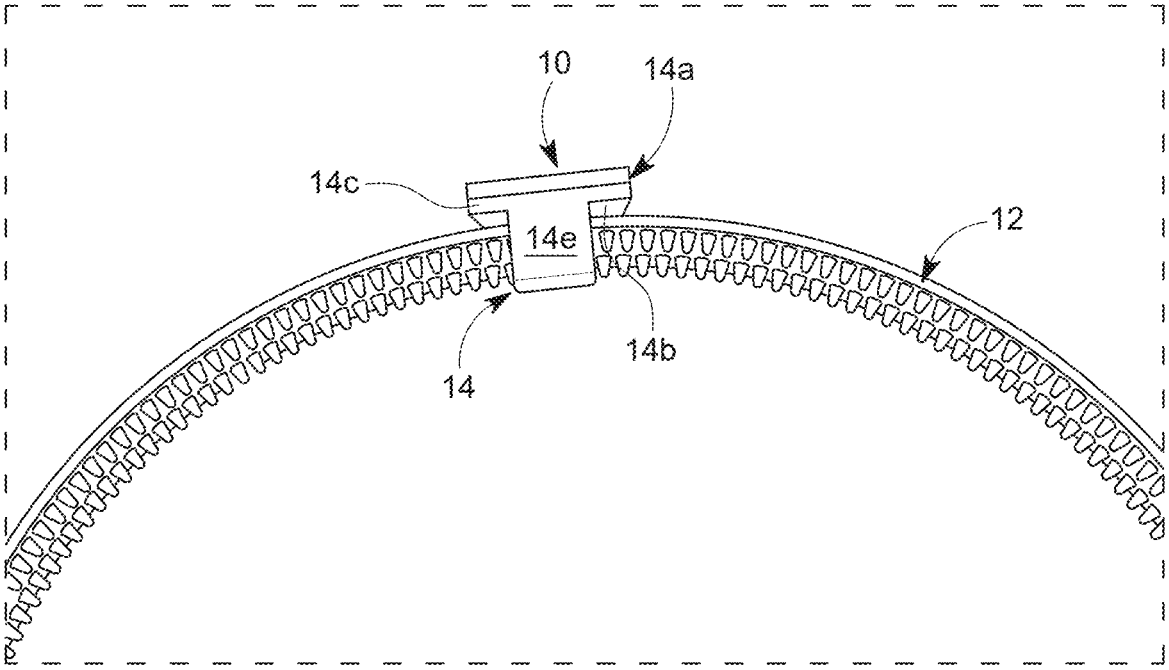
FIG. 5 is a side elevation detail view of the integrated headband and securing assembly of FIG. 3.
Figure 6:
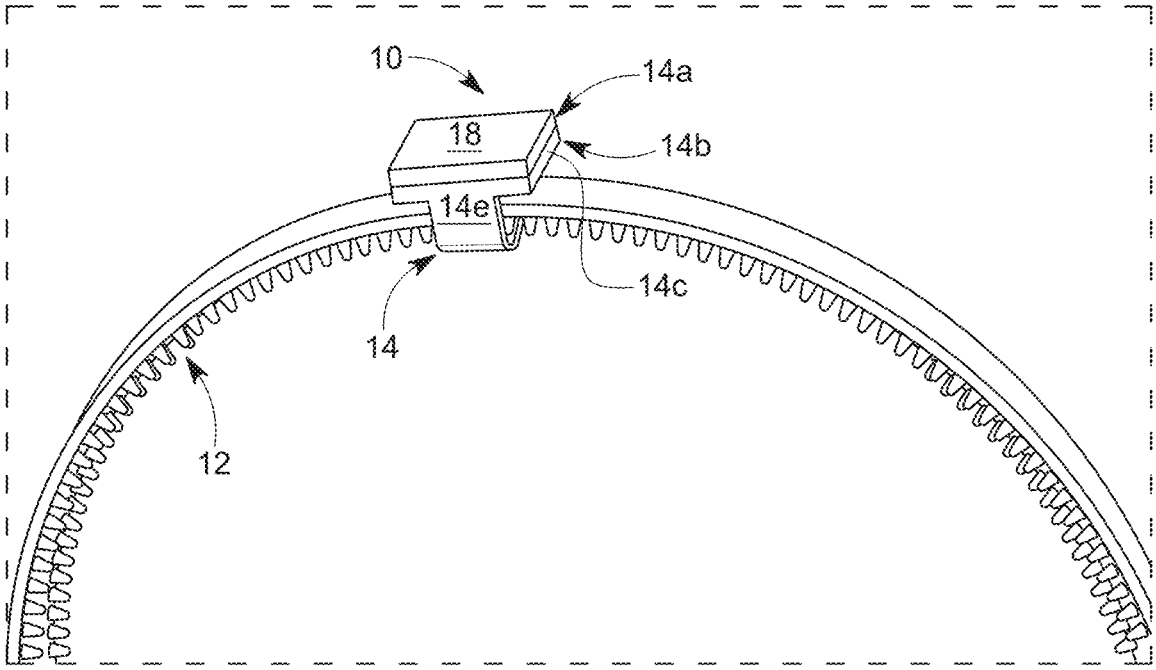
FIG. 6 is a perspective detail view thereof.

FIGS. 5 and 6 illustrate the structure and functionality of the securing device 10 integrated with the headband 12. The base 14 features spaced-apart upper and lower surfaces, 14*a* and 14*b*, respectively, with a lateral side surface 14*c* having an integral projection 14*e* forming a spring clip that interacts with the headband 12 to provide a secure yet removable connection. Adhesive material 18 affixed to the upper surface 14*a* is configured to adhere to the inner upper surface 20 of the graduation cap 9, ensuring a stable attachment between the cap and the attachment system 8.

Figure 7:
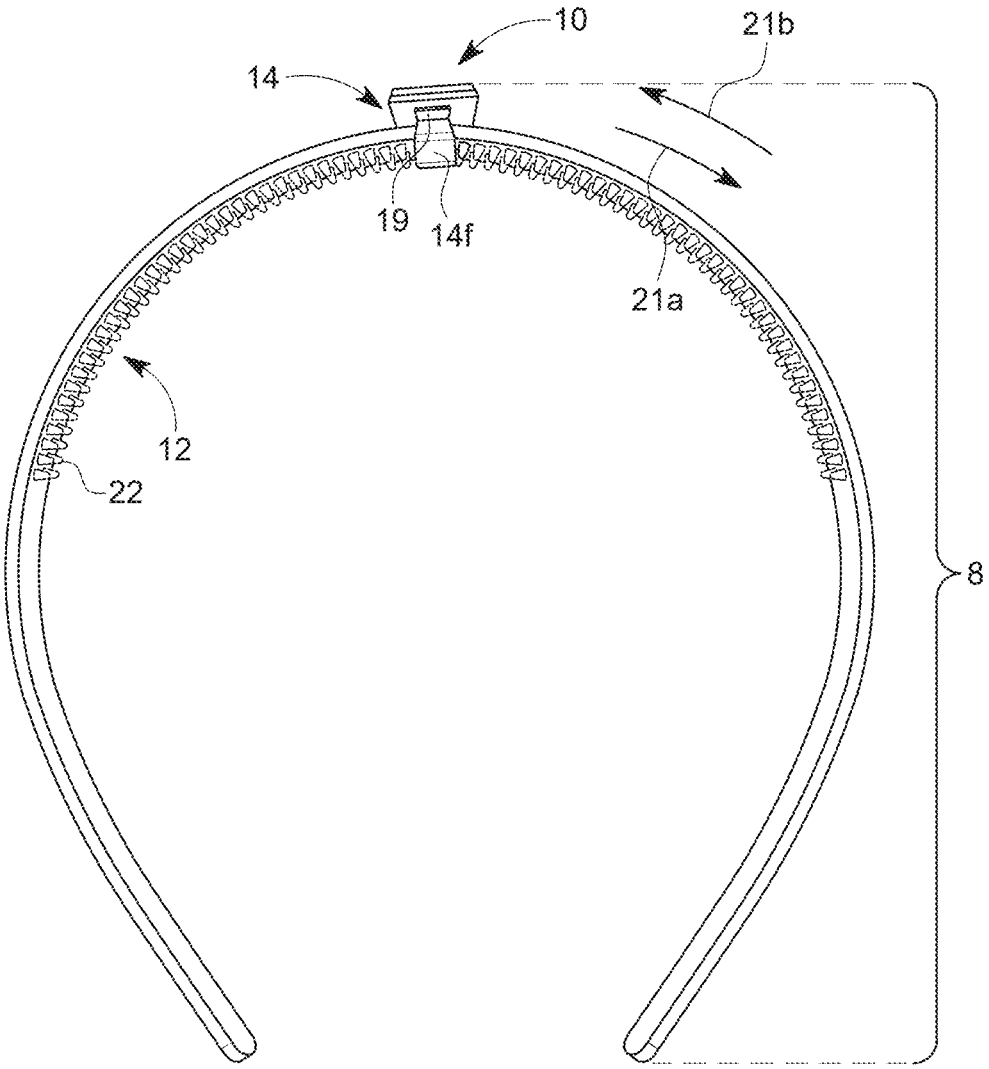
FIG. 7 is a schematic diagram thereof, illustrating movement of the securing assembly along the headband.

FIG. 7 illustrates the interaction between the securing device 10 and the headband 12 according to some embodiments of the present invention. The securing device 10 includes a base 14, a tab 19, and a clip portion 14*f*, which engages with the projection 22 on the headband 12. The tab 19 and the clip portion 14*f* allow the base 14 to move in a first direction 21*a* or a second direction 21*b* for adjustment or detachment. The projections 22 on the headband 12 function as teeth, retaining the headband 12 in place in the user's hair.

Figure 8:
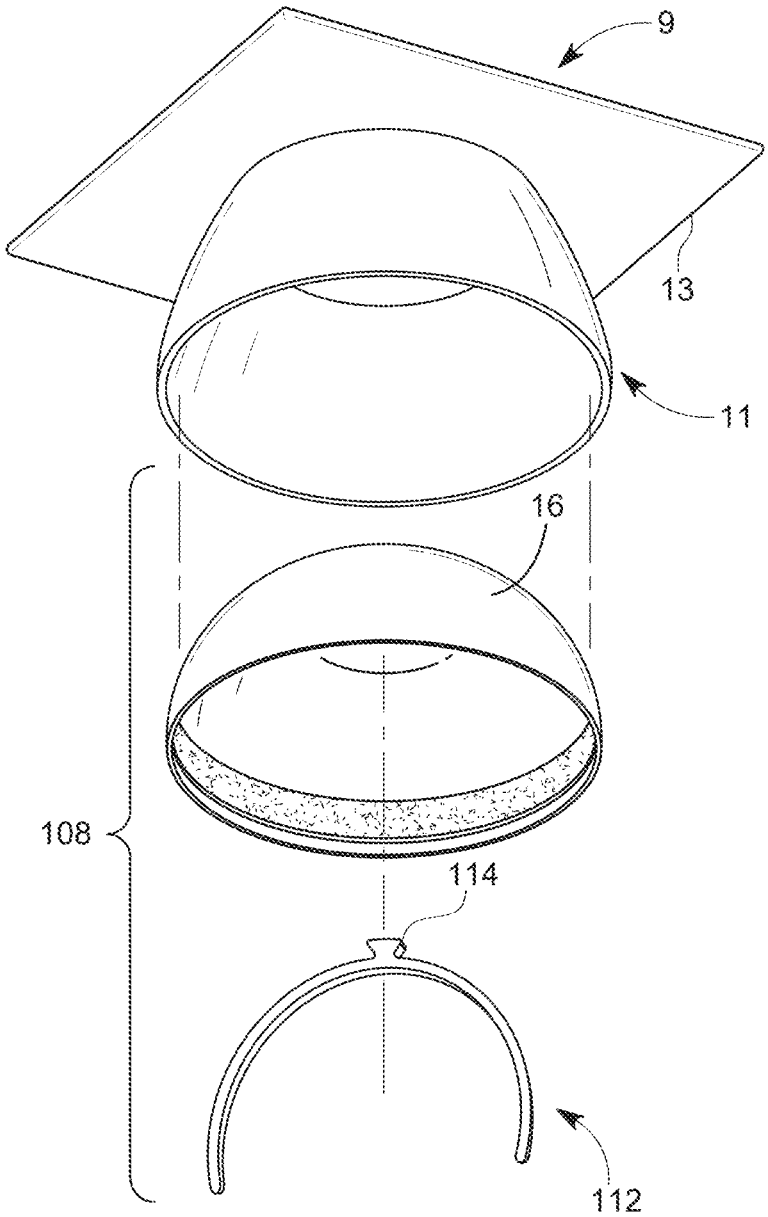
FIG. 8 is an exploded view of a securing and shaping assembly according to another embodiment of the present invention.

FIG. 8 provides an exploded view of the components of the securing and shaper assembly 108 integrated with the graduation cap 9 according to an embodiment of the present invention. A shaper bowl 16 is positioned beneath the crown 11 and is configured to retain the shape of the cap while providing structural support. A mounting platform 114 is monolithically formed into the headband 112 and is positioned at the base of the shaper bowl 16 in use to ensure a stable connection between the shaper bowl 16 and the wearer's head.

Figure 9:
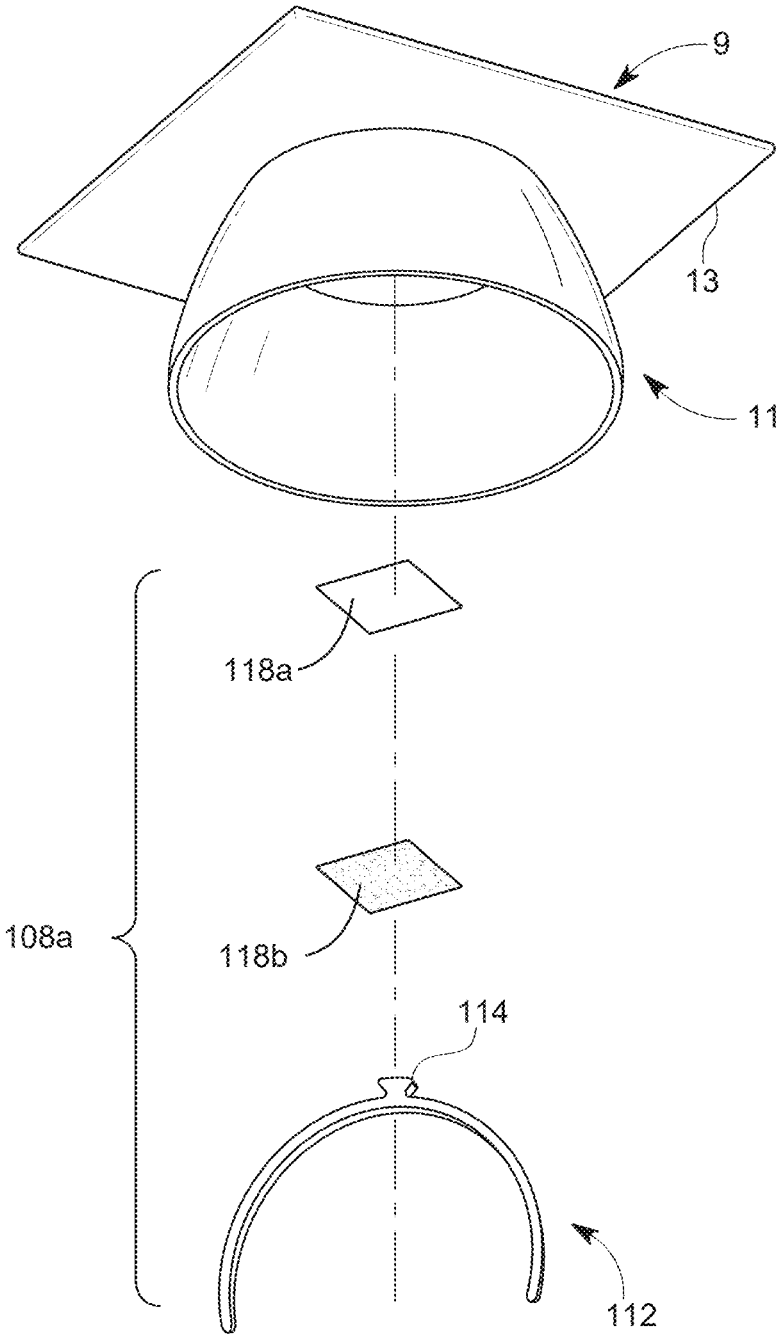
FIG. 9 is an exploded view of an attachment system for securing a graduation cap to a headband according to another embodiment of the present invention.

FIG. 9 shows an exploded view of the components of the attachment system 108*a* integrated with the graduation cap 9. The attachment system 108*a* includes hook and loop fastener elements 118*a*, 118*b*, which engage with one another to form a secure connection. The hook or loop fastener element 118*a* is adhered to the interior surface of the graduation cap 9. The mating hook or loop fastener element 118*b* is affixed to the mounting platform 114, which serves as the base for securing the headband 112 to the graduation cap 9.

Figure 10:
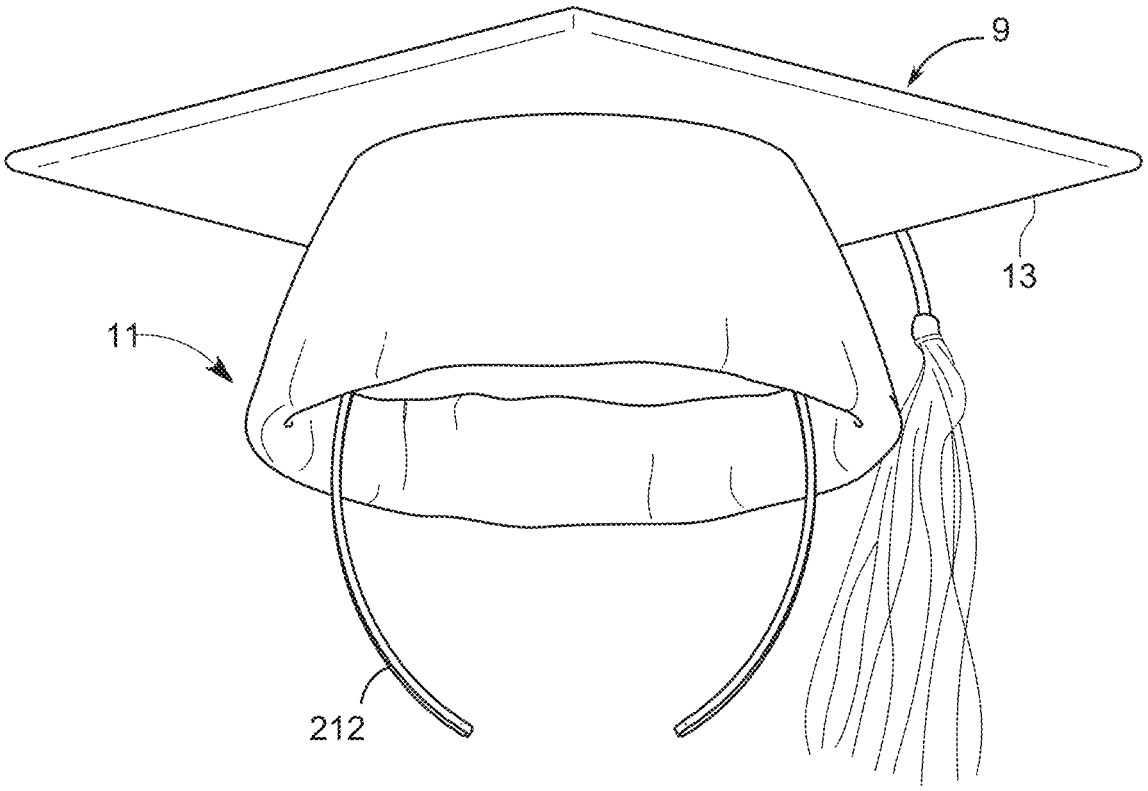
FIG. 10 is a perspective view of a securing and shaping assembly according to another embodiment of the present invention, shown in a use configuration.

FIG. 10 illustrates a perspective view of a graduation cap 9 with an alternative embodiment of the attachment system, featuring a headband 212. The headband 212 is positioned beneath the crown 11 and serves as the primary securing mechanism for this embodiment of the graduation cap.

Figure 11:
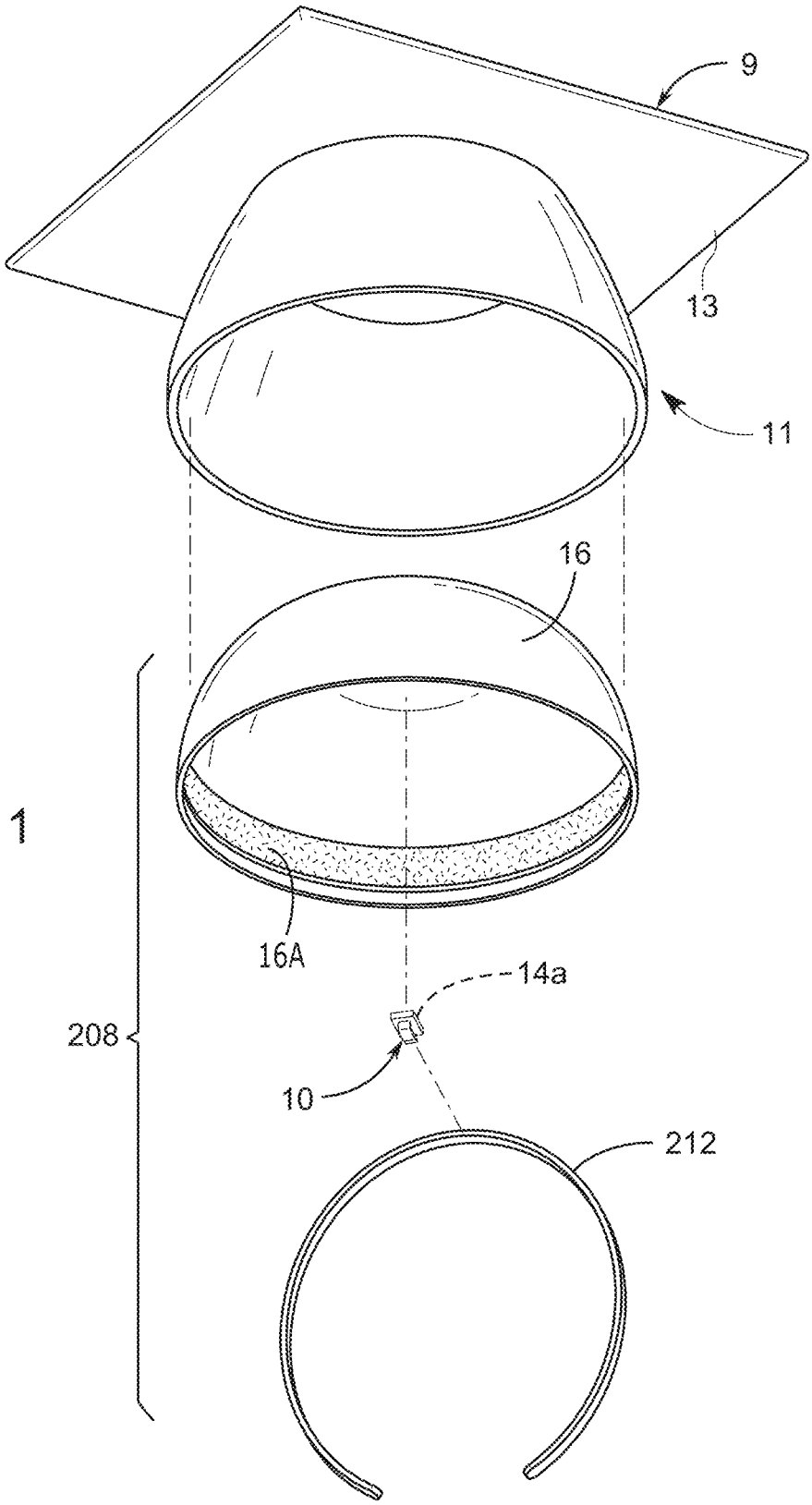
FIG. 11 is an exploded view thereof.
Figure 12:
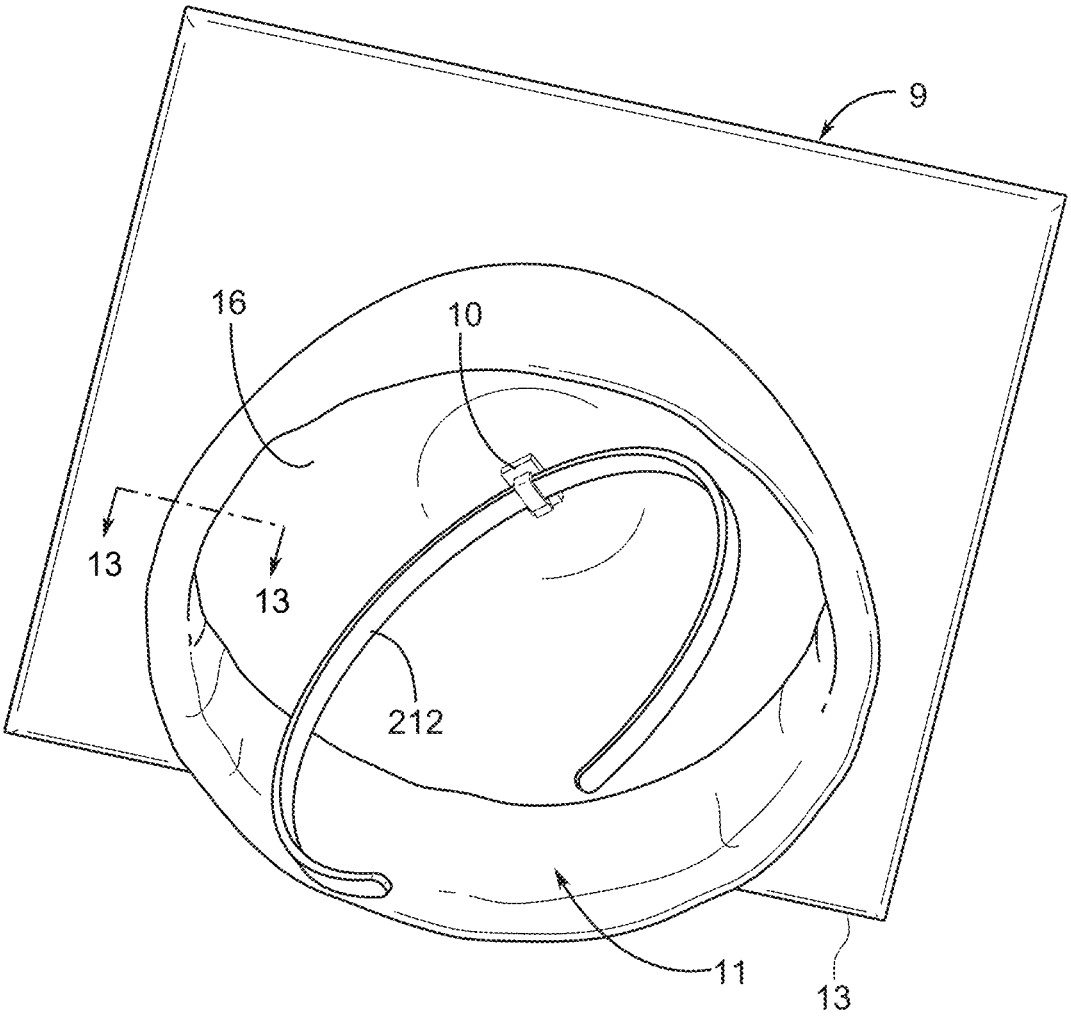
FIG. 12 is another perspective view thereof.

FIGS. 11 and 12 illustrate the components and integration of the securing and shaper assembly 208 within the graduation cap 9. The shaper bowl 16 is adhered to the crown 11 using the adhesive strip 16*a*, which secures excess fabric and ensures the cap retains its shape. The base 14*a* connects the shaper bowl 16 to the securing device 10, which facilitates attachment to the headband 212.

Figure 13:
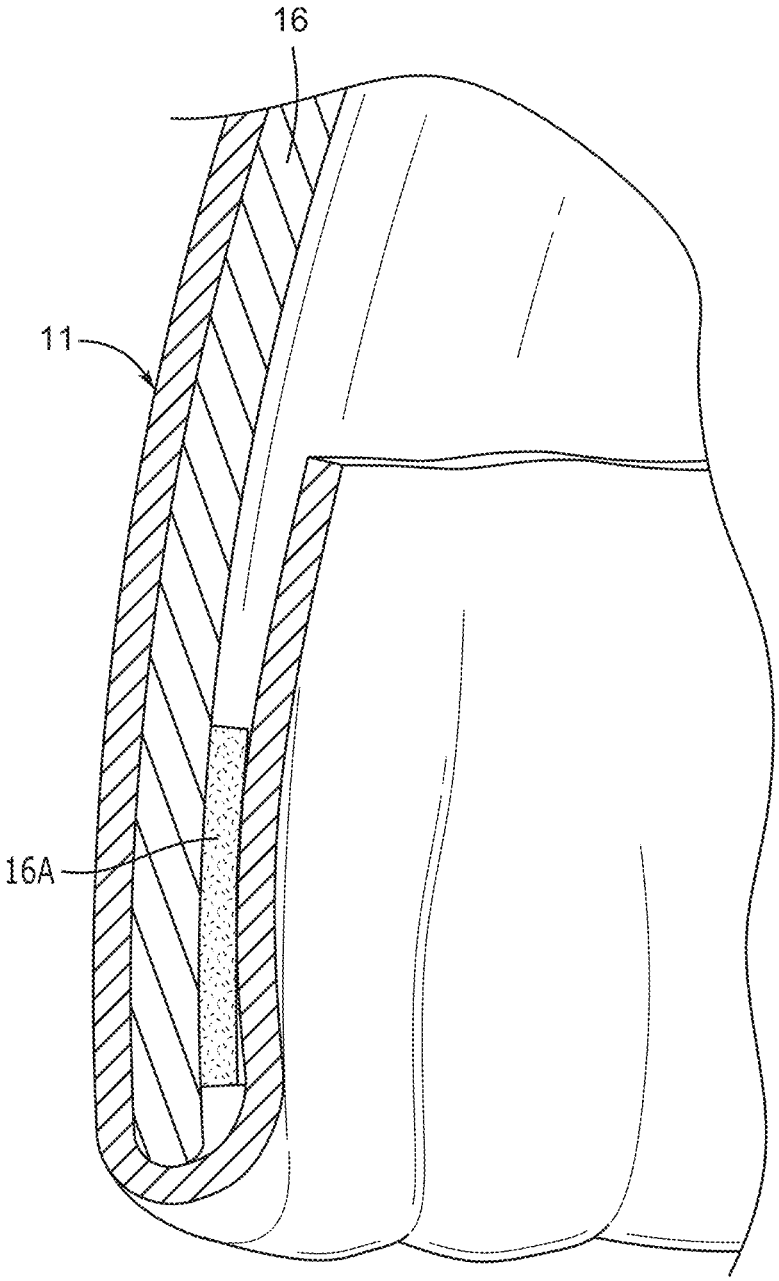
FIG. 13 is a sectional view thereof, taken along line 13-13 of FIG. 12.

FIG. 13 illustrates a sectional view of a graduation cap, showing the shaper bowl 16 adhered to the crown 11 using an adhesive strip 16*a*. The shaper bowl 16, positioned within the crown 11, provides structural support to maintain the cap's shape and ensures a snug fit. The adhesive strip 16*a*, affixed to the rim of the shaper bowl 16, secures excess fabric and adheres detachably to the inner surface of the crown 11, allowing for easy reattachment and ensuring a neat appearance during use.

Figure 14:
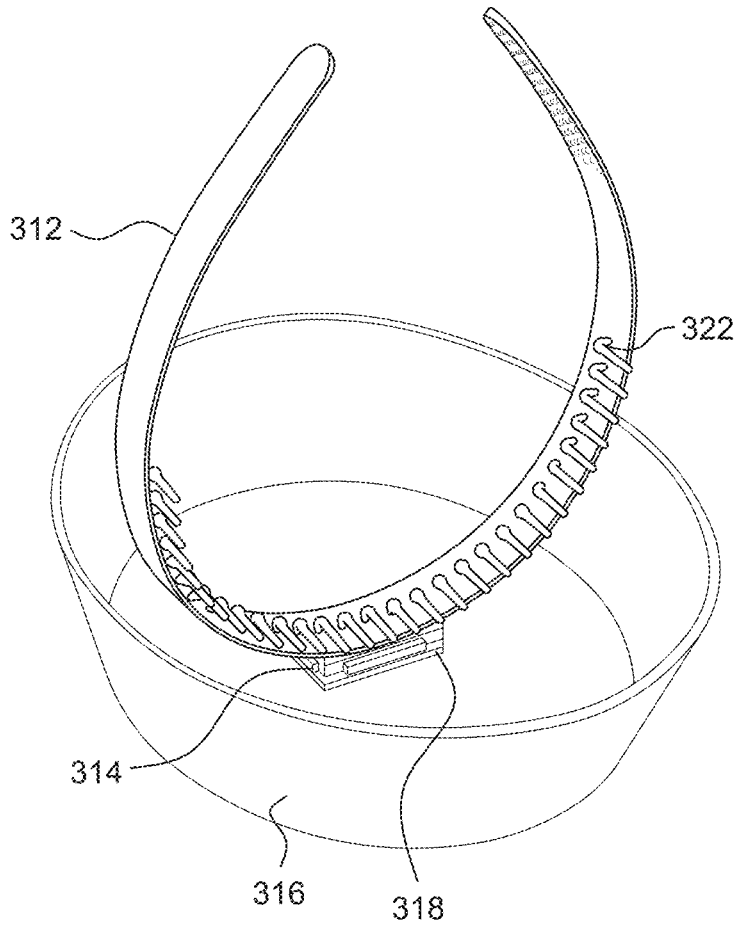
FIG. 14 is a bottom perspective view of a cap securing assembly according to an embodiment of the present invention.

FIG. 14 illustrates a cap shaping and securing assembly according to another embodiment of the present disclosure, comprising a headband 312, a platform 314, a shaper bowl 316, an adhesive strip 318, and teeth 322. The headband 312, with regularly spaced teeth 322 on its concave surface, engages the wearer's hair to provide a secure fit. The platform 314, integrated with the headband 312, serves as a mounting interface for the shaper bowl 316. The shaper bowl 316 retains the cap's shape and accommodates excess fabric, which can be secured by an adhesive strip 16A affixed to its inner surface (see FIG. 13). This configuration ensures the cap remains stable and maintains its structural integrity during use. The teeth extend perpendicular to the headband surface and have a 90° bend, such that a free end of each tooth extends beyond the width of the headband.

In some embodiments, the platform 314 is configured to couple to the shaper bowl 316 using adhesive or a snap-fit mechanism 318. The platform 314 may include protrusions or tabs that align with corresponding slots or recesses on the shaper bowl 316. When the protrusions are inserted into the slots, they snap securely into place, forming a stable connection between the platform 314 and the shaper bowl 316. This snap-fit design allows for easy assembly and disassembly, ensuring the shaper bowl 316 can be quickly attached or detached from the platform 314 as needed.

Illustrated and described in this patent specification is an attachment system for a graduation cap (or "mortar board"). While the present subject matter is described with reference to an exemplary embodiment, the present subject matter is not limited to this embodiment (of the attachment system) described herein. On the contrary, alternatives, changes, and/or modifications shall become apparent to a person of ordinary skill in the art ("POSITA") after this specification is read and its figures reviewed. Therefore, all alternatives, changes, and modifications are to be treated as forming a part of the present subject matter insofar as they fall within the spirit and the scope of the appended claims.

It should be understood, of course, that the foregoing relates to exemplary embodiments of the invention and that modifications may be made without departing from the spirit and scope of the invention as set forth in the following claims.

What is claimed is:

1. A cap securing system, comprising: a headband configured to be positioned about a wearer's head, the headband having a bottom surface configured to be nearest the wearer's head when worn, the bottom surface having a center surface area and an outer edge; a plurality of protrusions formed on the bottom surface of the headband, the plurality of protrusions extending outwardly from the center surface area, each of the plurality of protrusions having a perpendicular portion relative to the center surface area and a bent portion extending laterally beyond the outer edge, the plurality of protrusions configured to engage the wearer's hair; a shaper bowl configured to retain a shape of the cap, the shaper bowl having a concave inner surface, a convex outer surface, a flat crown portion, a re-adherable adhesive material configured to detach and reattach the cap, and a rim with a frustoconical shape; the shaper bowl configured to be positioned within a crown of the cap to retain the shape of the cap; and an attachment means operatively interconnecting the headband and the shaper bowl for releasably engaging the cap; wherein the headband and the attachment means cooperate to secure the cap to the wearer's head.

2. The cap securing system of claim 1, wherein the shaper bowl includes a double-sided adhesive material affixed to at least one of the inner surface or the outer surface operative to detachably engage a portion of the cap and secure excess fabric from the cap.

3. The cap securing system of claim 1, wherein the attachment means comprises a platform formed on the headband and an adhesive material secured to an upper surface of the platform.

4. The cap securing system of claim 1, wherein the headband is coupled to the shaper bowl without an adhesive.

5. The cap securing system of claim 1, wherein the attachment means comprises a base with a projection on a lateral side surface thereof that forms a spring clip configured to removably secure the headband to the base.

6. The cap securing system of claim 1, wherein the attachment means is selected from the group consisting of: a clip, a hook and loop fastener, self-adhesive tape, holes operative to accommodate the headband, a snap-fit fastener, and any combination thereof.

7. A method of securing a cap to a wearer's head, the method comprising: providing the cap securing system of claim 1; fastening the headband to the inner surface of the shaper bowl; mounting the cap to the outer surface of the shaper bowl; and positioning the headband, with the cap attached, onto the wearer's head so that the headband engages the wearer's hair.

8. The method of claim 7, wherein the shaper bowl includes a re-adherable adhesive material affixed to at least one of the inner surface or the outer surface for detachably engaging a portion of the cap, wherein the re-adherable adhesive material is selected from the group consisting of double-sided adhesive tape, carbon nano tube tape, poster tape, hook and loop closures, poster putty, and any combination thereof.

9. The cap securing system of claim 1, wherein the re-adherable adhesive material is selected from a group consisting of: double-sided adhesive tape, carbon nanotube tape, poster tape, hook-and-loop closures, poster putty, and any combination thereof.

* * * * *